US006378334B1

(12) United States Patent
Hector

(10) Patent No.: US 6,378,334 B1
(45) Date of Patent: Apr. 30, 2002

(54) JEWELRY ARTICLES INCLUDING SMALL BEADS ARRANGED IN DESIGNS IN DECORATIVE FRAMEWORK

(76) Inventor: Valerie Hector, 2910 Simpson, Evanston, IL (US) 60201

( * ) Notice: Subject to any disclaimer, the term of this patent is extended or adjusted under 35 U.S.C. 154(b) by 0 days.

(21) Appl. No.: 09/512,020

(22) Filed: Feb. 24, 2000

(51) Int. Cl.[7] ..... A44C 5/00
(52) U.S. Cl. ..... 63/26; 63/38; 63/3; 63/33
(58) Field of Search ..... 63/1.11, 1.16, 63/26, 38, 39, 20, 21, 33, 37, FOR 100, FOR 101, 3, 4, 1.18, DIG. 3

(56) References Cited

U.S. PATENT DOCUMENTS

| | | | | | |
|---|---|---|---|---|---|
| 1,441,924 | A | * | 1/1923 | Hartmann | 63/38 |
| 3,733,852 | A | * | 5/1973 | Johnson et al. | 63/2 |
| 5,238,278 | A | * | 8/1993 | Kamper | 294/74 |
| 5,333,930 | A | * | 8/1994 | Glenn | 297/219.11 |
| 5,398,993 | A | * | 3/1995 | Chen | 297/230.11 |
| 5,494,734 | A | * | 2/1996 | Widders | 428/255 |
| 6,014,988 | A | * | 1/2000 | Gagnon et al. | 138/168 |
| 6,241,572 | B1 | * | 6/2001 | Braginsky | 446/85 |
| 6,276,368 | B1 | * | 8/2001 | Giamalva | 132/201 |

FOREIGN PATENT DOCUMENTS

GB WO 99/07245 * 2/1999

* cited by examiner

*Primary Examiner*—Anthony Knight
*Assistant Examiner*—Andreé L Jackson
(74) *Attorney, Agent, or Firm*—Paul H. Gallagher

(57) ABSTRACT

Decorative beads strung on a thread, and such string of beads are wrapped on a bead bar to form a tube of beads and the beads are threaded together to secure them in the tube form. The bead bar is one of many in a frame, and all the beads thus mounted in the frame produce a pleasant and decorative effect, and the frame cooperates with the beads in producing that effect. The beads are secured together, and secured in the frame solely by the thread, and without the use of adhesives. The beads are of a wide variety of characteristics, and the frames are of different shapes, and a great variety of jewelry articles are produced, including bracelets, necklaces, brooches.

22 Claims, 5 Drawing Sheets

JEWELRY ARTICLES INCLUDING SMALL BEADS ARRANGED IN DESIGNS IN DECORATIVE FRAMEWORK

BACKGROUND OF THE INVENTION

1. Field of the Invention

The invention resides in the field of jewelry beads such as are ordinarily used to make up bracelets, pendants, necklaces, and as individual pieces used as brooches and pins.

2. Prior art

My prior U.S. Pat. No. 5,590,546, dated Jan. 7, 1997.

SUMMARY OF THE INVENTION

A broad object of the invention is to provide a new article of jewelry including beads mounted in framework, having the following features and advantages;

1. The beads are of very small dimensions, and produce a wide variety of visual effects.

2. The beads are strung together on a string, without the use of any adhesive materials.

3. The framework may be of any of a variety of shapes and sizes.

4. The framework consists of a number of independent components or units, which are independently of unusual appearance, and may be utilized as pins and brooches, and which may be secured together in a string to form such articles as bracelets, necklaces, etc.

BRIEF DESCRIPTIONS OF THE INDIVIDUAL FIGURES OF THE DRAWINGS

DETAILED DESCRIPTION OF THE DRAWINGS

Figure 1:
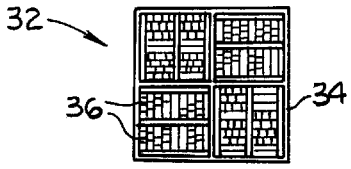
FIG. 1 shows a single component, which can be used as a single article of jewelry, or used with others as in a bracelet.

Referring in detail to the drawings, attention is directed to FIGS. 1–4, which show one article of jewelry 30, in this case a bracelet, which is one of a great number of articles, of different kinds, lying within the scope of the invention, that can be made up of different elements of construction. The bracelet 30 is made up of a plurality of components 32, in this case six, of a size and detail construction constituting one of a great variety of sizes and designs. Each component, in this form, is approximately 1" on edge, a rule 33 being shown to shown the dimensions, accommodating reproduction of the drawing on different scales.

The components 32 are each a separate piece and are hinged together by hinge means 33' as referred to again hereinbelow. Each component includes a main frame 34 and beads 36. The frame 34, in this case square in shape, includes perimeter members 38 and cross members 40. The perimeter members are identified with the postscripts a, b, c, d to identify the individual members in various views, and the cross members similarly identified individually with the postscripts a, b, c, d.

The perimeter members 38 form a main space 42 divided into four smaller spaces 44 by the cross members 40, the smaller spaces being also individually identified with the postscripts a, b, c, d.

The frame 34 also includes bars 46, there being two bars in each of the smaller spaces 44. These bars extend between the corresponding opposed members 38 and 40.

Figure 4:
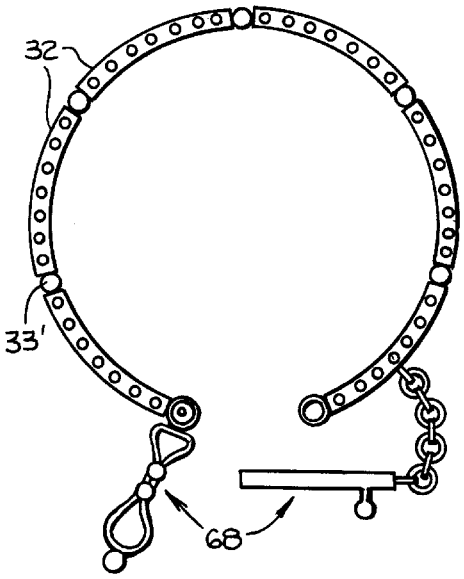
FIG. 4 is an edge view of the bracelet shown in FIG. 3, in nearly closed position, as to be placed on the wrist.
Figure 5:
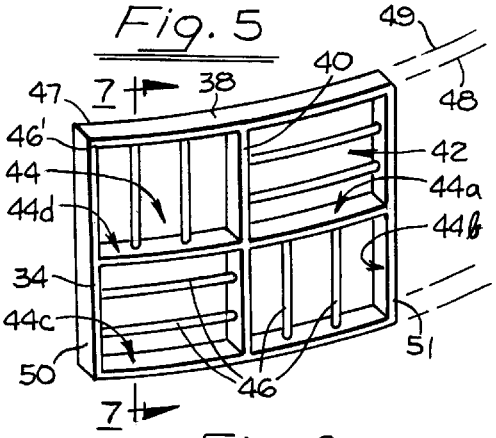
FIG. 5 is a perspective view of a curved frame in which a plurality of beads are mounted.
Figure 6:
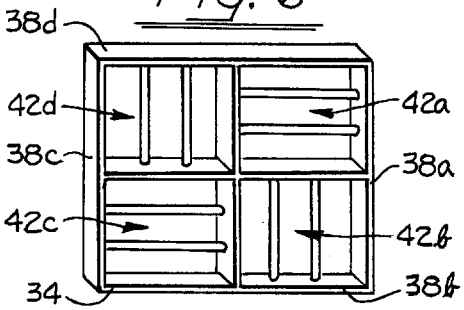
FIG. 6 is a view, similar to FIG. 5, of a straight frame.

The frame is composed of a single, integral, one-piece member, as best shown in FIGS. 4–6. It is produced by a known kind of lost wax process, i.e., a prototype being originally formed, and put in a die to form a pattern. The pattern so formed, after removal from the die, is covered with ceramic particles, which form a shell, and the wax is then heated and it drains out of the shell. The shell is thereafter used as a mold for the final product.

In this form of the device, there are two bars 46 in each of the smaller spaces 44, and are relatively arranged, progressing in angular direction, alternately oppositely, that is, in the smaller space 42*a* the bars 46 are horizontal, in the space 42*b,* vertical, etc.

In the form shown in FIGS. 4 and 5, each component 32 is curved, the opposite side surfaces 46', 47 lying in cylindrical surfaces represented by the dot-dash lines 48, 49 (FIG. 5), while the other two surfaces 50, 51 are straight. The frame 34 (FIG. 5) thus lies in the space between the lines 48, 49, the transverse direction between these lines indicating the thickness of the component. The perimeter members 38 and cross members 40 are considered main frame members and all are of the same thickness.

Figure 7:
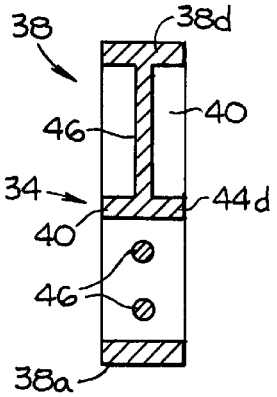
FIG. 7 is a sectional view taken at line 7—7 of FIG. 5.

Alternatively, the frame 34 may be flat, as shown in FIG. 6. The sectional view of FIG. 7 is a section through FIG. 5 and through FIG. 7 at the same location.

Figure 15:
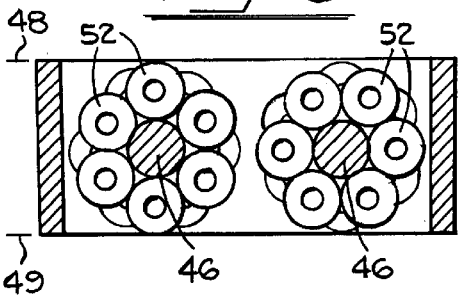
FIG. 15 is a sectional view taken at line 15—15 of FIG. 14.

The bars 46 (FIG. 7) are of a diameter less than the thickness of the main frame members, the beads being disposed in a tube having an outside diameter similar to the thickness of the main frame, as described below (FIG. 15).

Figure 2:
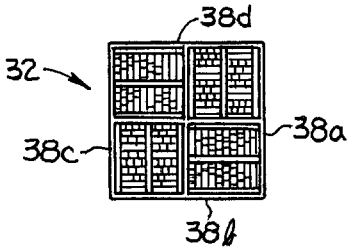
FIG. 2 is a view of the side opposite that of FIG. 1.
Figure 8:
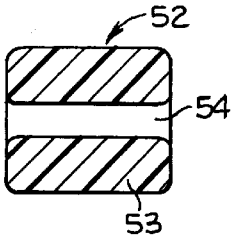
FIG. 8 is a sectional view of a bead, on a greatly enlarged scale.

A bead 52 is shown in FIG. 8, including a body 53 with a threading hole 54 extending therethrough. This bead is one of a variety of beads that may be utilized, a large number of these beads selectively forming the various bead groups 36 (FIGS. 1, 2). In this case, a single bead may be 1 millimeter in length and in diameter.

Figure 9:
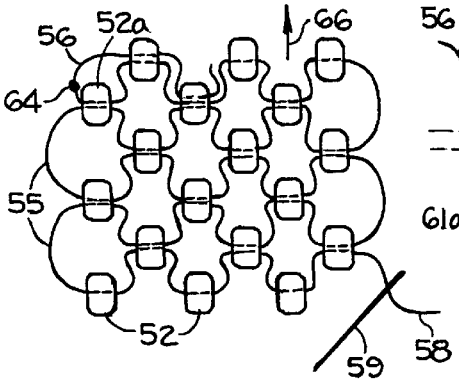
FIG. 9 is a view showing steps in threading the beads.
Figure 10:
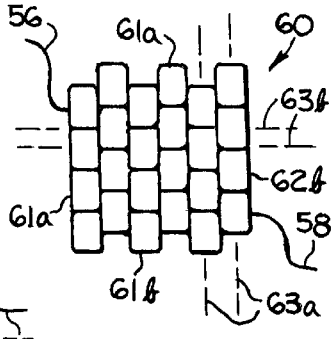
FIG. 10 shows the thread of FIG. 9 pulled tight, which forms a rectangular web or panel of the beads.

FIG. 9 is a display of a plurality of beads 52 threaded together on a thread 55, such as quilting thread, as diagrammatically shown. This figure shows a peyote stitch, indicating the steps in forming the stitch, and FIG. 10 showing the beads after they are strung and pulled together. The thread 55 has a trailing end or tail end 56 and a leading end 58 on which a needle 59 is shown.

Upon pulling the beads tight on the thread, they form a web or panel 60, which at this step is in the form of a rectangle, having a longitudinal direction 60*a,* end edges 61*a,* 61*b,* and side edges 62*a,* 62*b.* The web is also considered as having tiers of beads extending longitudinally, indicated by the lines 63*a,* and rows extending transversely, indicated by the lines 63*b.* This web is flexible and will be formed into a tubular shape as explained below.

Figure 11:
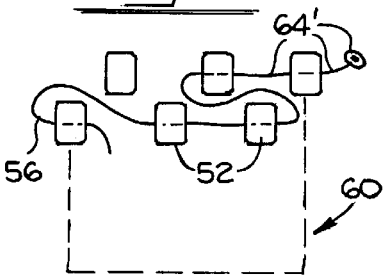
FIG. 11 shows the trailing end of the thread sewed in and secured.

Threading the beads and forming the web, constitute an important feature of the invention. The beads are held in place only by the thread and as confined by the frame, and the threading or lacing of the thread accomplishes that result. For this purpose, in the threading step, a knot 64 is formed in the trailing end of the thread and it engages the first bead 52*a* and prevents the thread from being pulled entirely therethrough. After the leading portion of the thread is pulled through all the beads, the trailing end 56 is retracted a slight amount, and the knot 64 is undone. Then the needle is applied to the trailing end of the thread and that end is then threaded through the beads of several rows in the same direction as was the leading end before, as indicated at 64' in FIG. 11. In this step, the thread is threaded through several rows, and if desired, additional beads, at skip locations, as shown at 64' in FIG. 11. At this step, there are two threads, or runs, in the beads of those few rows, and there may even be three. Then the end of the thread that is exposed beyond the final bead is cut off, at 64", leaving the ultimate end of the thread imbedded in the interior of the last bead. This will hold the thread in place after the web is applied to the frame as described below.

Figure 12:
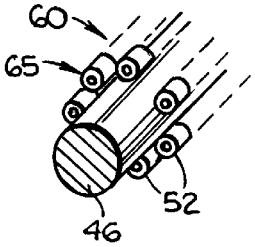
FIG. 12 shows in semi-diagrammatic form, a first step of applying the web of beads to the frame, and thereby forming a tube of the web of beads.
Figure 13:
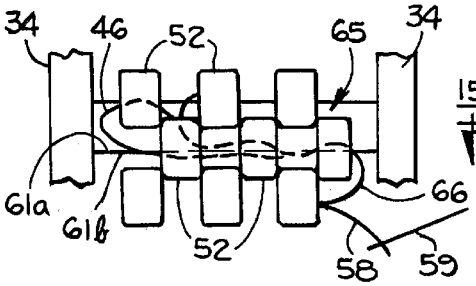
FIG. 13 is a face view taken from the right of FIG. 12, and showing the step of securing the leading end of the thread.

The web or panel 60 is then wrapped around a bead bar 46 (FIG. 12) to form a tube identified 65, and the ends of the web or panel are stitched together as shown diagrammatically in FIG. 13. This figure is a face view of the frame and bead bar, with the web 60 applied thereto with the opposite ends of the web, meeting, or nearly so, at the position 65'. The needle 59 (of FIG. 9) is then again applied to the leading end 58 of the thread (FIG. 13), and threaded through the beads of one or more rows on each of opposite sides of the meeting line 65' as indicated at 66. In this case also, the thread is passed through the beads in the same direction as in threading it in the first instance at 64'. Also there will be two, or possibly three runs of thread through those additional rows. This leading end of the thread is pulled tight to again tighten the beads in the web, and then the excess portion of the thread is cut off. This cut off position is at the end of a bead, and the new end of the thread so formed is positioned entirely inside the last bead, this threading step securing the leading end of the thread in the beads to prevent its being pulled out. These threading steps result in the tube being pulled tight against the bar, and it is thereby held in secured position, being confined at the ends by the elements of the frame.

Figure 14:
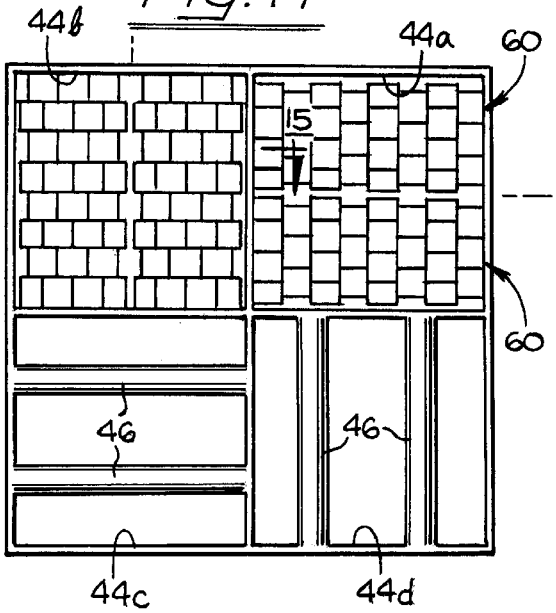
FIG. 14 is a large scale face view showing a frame half filled with beads.

The webs are then applied to the various remaining bars successively in the same manner as represented in FIG. 14. This figure shows two of the smaller spaces, 44*d,* 44*a* filled with the bead tubes, while the other spaces 44*b,* 44*c* have not been yet been filled, the bead bars 46 being thereby exposed. FIG. 15, taken on line 15—15 of FIG. 14, shows the relationship of the bead tubes on the adjacent bars.

The tubes are continuous circumferentially, that is, when they are applied to the bars, the beads are exposed entirely there around (FIG. 15), and they appear similar from opposite sides of the component (see FIGS. 1 and 2). Also the outer diameter of the tubes is similar to the thickness dimension of the frame, i.e. the distance between the surfaces 48, 49 (FIG. 15).

Figure 3:
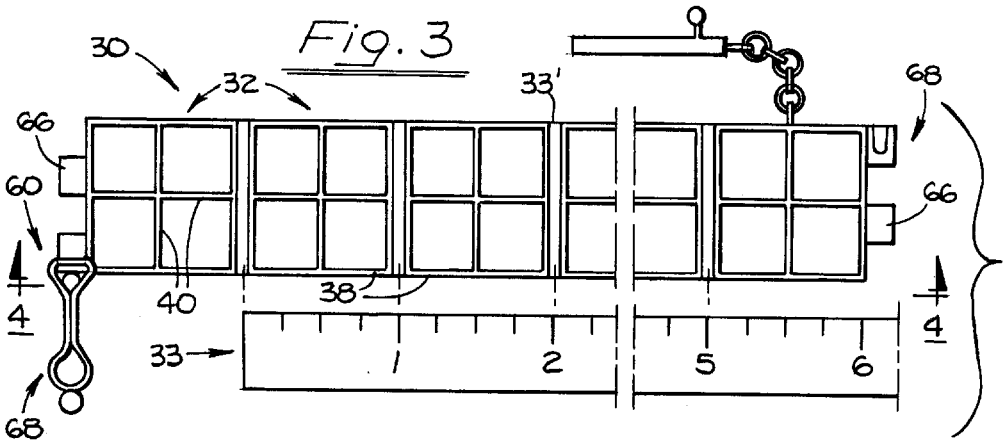
FIG. 3 is a face view of a bracelet made up of a series of components of FIGS. 1 and 2.
Figure 16:
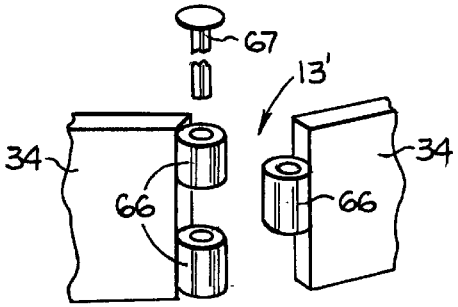
FIG. 16 is a fragmentary perspective view of a hinge means applied to the frame.

After the frame 34 (FIGS. 5 and 6) is formed, and either before or after the beads are applied thereto, the elements of the hinge means 33' are applied. These elements are shown in FIG. 16 and include loops 66 welded to the frame members, and a pin 67. The respective parts of a clasp 68 are suitably secured to the end components of the bracelet (FIG. 3).

Figure 17:
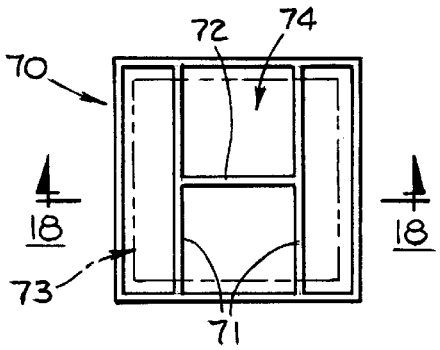
FIG. 17 is a face view of another form of applying the beads to the frame.
Figure 18:
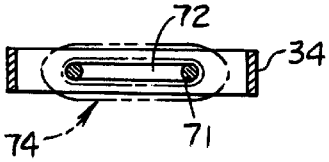
FIG. 18 is a sectional view taken at line 18—18 of FIG. 17.
Figure 20:
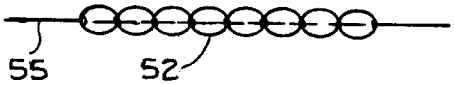
FIG. 20 shows a different form of stringing the beads.
Figure 21:
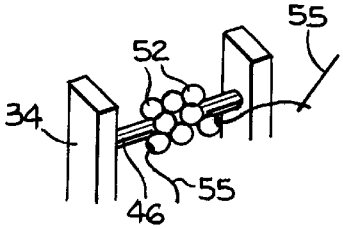
FIG. 21 is a fragmentary perspective view of a step in using the beads of FIG. 20.
Figure 22:
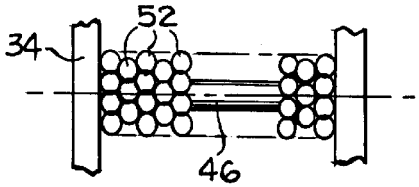
FIG. 22 shows the string of FIG. 22 fully wound on the bead bar.

The foregoing frame construction described above and shown best in FIGS. 5–7, includes two bead bars 46 in each small space 44. However, FIGS. 17, 18 show a frame 70 similar to that of FIG. 5 and having bead bars 71 similar to the bars 46. In the present case, an additional bead bar 72 interconnects the other bars 71 at about the central point of the latter. This frame 70, with the bars 72, is of one piece construction, similar to the frame of FIGS. 5–7.

In the present case (FIGS. 17, 18), the web 73 of beads is made similar to the web 60, but is longer. This web 73 is fitted on the two spaced parallel bars 71, encompassing those bars as well as the middle bar 72 extending across the space 74. The web 73 constitutes a tube, but because of its size and proportion, is similar to a belt. This web of beads when so fitted in the frame, presents a uniform artistic area extending across the respective small space 42, instead of being in the form of separate tubes as in FIG. 14.

Figure 19:
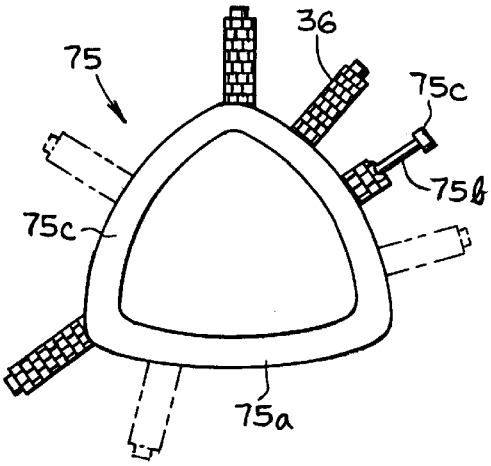
FIG. 19 shows bead bars in the form of prongs.

While the bead bars described above are each secured at both ends, the arrangement shown in FIG. 19 is also included in the scope of the invention. In this figure a brooch 75, having a frame 75*a* has bars 75*b* mounted at only one end thereon, forming prongs. The tubes of beads 36 are fitted on the prongs as in the cases described above. A knob 75*c* is secured to the outer end of each prong and the bead tube is confined longitudinally of the prong by the knob and the frame of the brooch.

Figure 23:
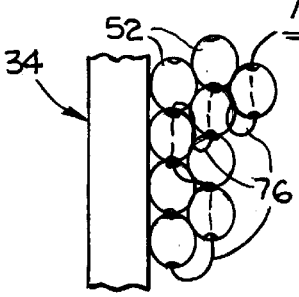
FIG. 23 is an enlarged fragmentary view of the terminal end of the bead string, showing the final securement of the bead string.

Another form of bead group is shown in FIGS. 20–23. In this case, a series of beads 52 are strung on a thread 55. This string of beads is wound on a bar 46 (FIGS. 21, 22) throughout a stretch wherein the beads engage opposite elements of the frame 34 and the string is confined by those frame elements (FIG. 23). The leading and trailing ends of thread are woven into the adjacent beads in the manner described above, as shown at 76 (FIG. 23), to secure the ends of the thread in the beads.

In the components thus made, the beads may be of selectively various colors, or of the same color, as well as of different design patterns formed by beads of different characteristics. Various sized beads may be used and various kinds of stitches also may be used. For example, a ladder stitch including long beads, may be utilized.

Figure 24:
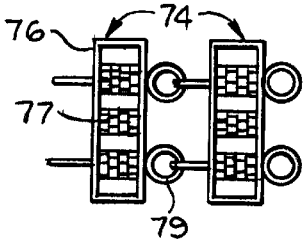
FIG. 24 shows another form of securing components together as in a necklace.

FIG. 24 shows two components 74 of a longer chain that may be a bracelet or a necklace. Each of these components includes a simple rectangular frame 76, and tubes of beads 77 spaced apart. These components are hinged at 79 and suitable clasps are secured to the ends of the chain.

Figure 25:
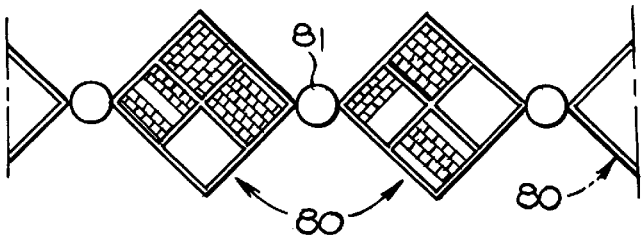
FIG. 25 shows another arrangement of securing components together in a bracelet.

FIG. 25 includes two components 80 which may be similar to the components of FIGS. 1–3, but secured together in corner-to-corner fashion by hinges 81. This may be a bracelet or a necklace with clasps at the end, similar to the construction of FIG. 3.

Figure 26:
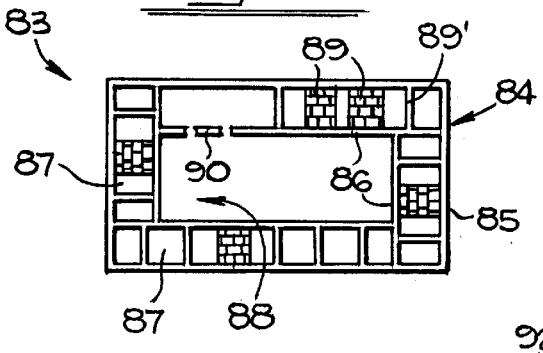
FIG. 26 shows a component frame structurally similar to that of FIGS. 5, 6 but including a different pattern, and forming a brooch.

The various components and elements are also adaptable to forming pins or brooches. FIG. 26 shows a brooch 83, including a frame 84 made up of outer and inner peripheral elements 85, 86. These peripheral elements form peripheral spaces 87 therebetween in which are mounted bead tubes 89, on bead bars 89' similar to the bars 46 (FIGS. 5–7). These bead tubes may be spaced apart, as shown, or may be closely adjacent each other. The inner elements 86 form an interior space 88 which may be left vacant. The usual clasp pin 90 is secured to the frame, on the side opposite that shown in FIG. 26. In this figure, the top inner element 86 is broken away and a fragment of the pin 90 shows therethrough.

Figure 27:
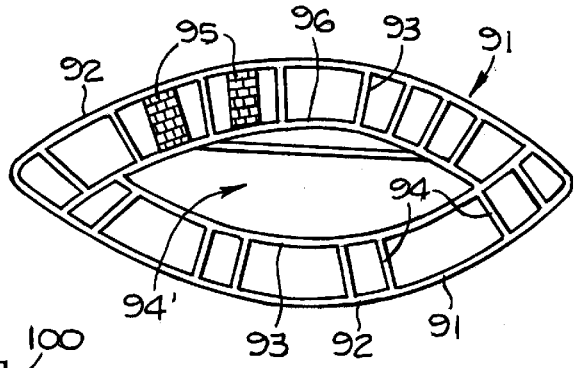
FIG. 27 shows a brooch similar to that of FIG. 26, but of a different pattern.

FIG. 27 shows another form the device may assume. In this case, a main frame 91 is somewhat in the shape of a football but with more pointed ends. The frame is made up of outer and inner peripheral elements 92, 93 similar to the corresponding ones of FIG. 26, and bead bars 94 extending between the spaced peripheral elements and inclined to positions essentially radiating from a central region 94'. Bead tubes 95 are placed on the bead bars and the usual clasp pin 96 is secured to the frame on the side opposite that shown.

Figure 28:
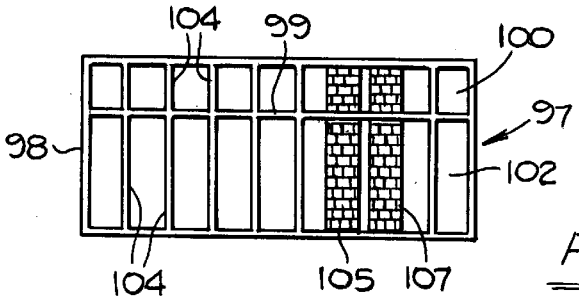
FIG. 28 shows a brooch similar to those of FIGS. 26 and 27, but of a still different pattern, in this case an abacus.

FIG. 28 shows still another form that the device may assume. In this case, a frame 97 includes a peripheral frame member 98 and a single interior frame element 99 extending longitudinally of the frame but off center forming a narrower interior space 100 and a wider interior space 102. The bead bars 104 extend through both spaces and the bead tubes 105 are applied to the bead bars.

The form shown in FIG. 28 is in the shape of an abacus and the bead tubes are formed in short sections as indicated at 107, so as to enable them to be slid along the bead bars, similarly to an abacus. This article is also provided with a clasp pin (not shown).

Figure 29:
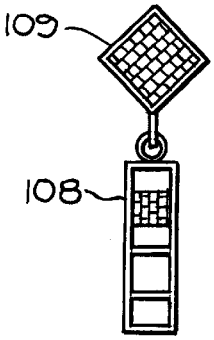
FIG. 29 shows a pair of components forming an earring.
Figure 30:
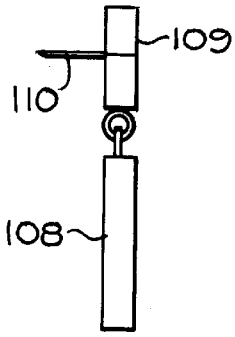
FIG. 30 is a side view of FIG. 29.

FIGS. 29, 30 show still another form of article. In this case a large component 108 is swingably mounted on a smaller component 109 having a pin 110, forming an earring. The smaller component may be similar to that represented in FIG. 18, with the pin 110 of the earring soldered to the bar 72 (FIG. 17).

Figure 31:
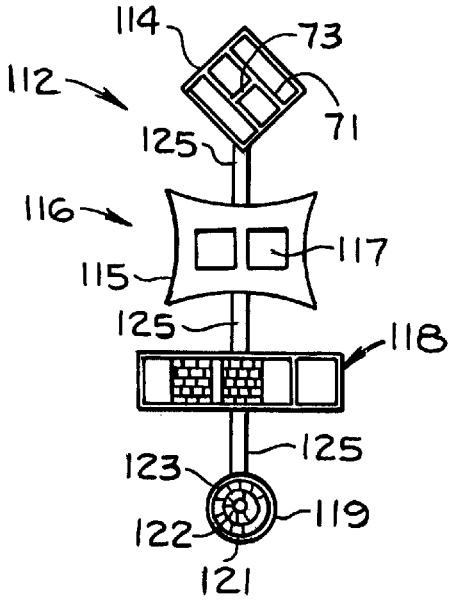
FIG. 31 is a face view of a brooch made up of a plurality of components in a linear arrangement.

The foregoing includes principally articles which are made up of a plurality of components secured together in a chain-like or swingable arrangement of single articles, constituting individual components, and in the latter case, each component is rigid in itself. However the scope of the invention is sufficiently broad to cover a plurality of components, each complete in itself, but all secured together in a rigid final article. For the latter, attention is directed to FIGS. 31 and 32. In FIG. 31, the pieces are aligned in a single line effect, and in FIG. 32, they produce a square effect.

In FIG. 31, the entire article is designated 112, the component 114 is similar to that of FIGS. 17, 18 including a frame having bars 71, 72 with a tube of beads 74 thereon. The next component 116 is a simple frame 115 without beads, but having square holes 117 unobstructed, providing contrast with the item of clothing on which the article is pinned.

Next below the item 116 is an article 118 similar to the article 108 of FIG. 29.

Below the item 118 is another component 119 which is preferably an item in the form of a cup 121 in which is a dome 122 with beads 123 mounted therein.

The four items 114, 116, 118, 119 are rigidly connected together by rigid rods 125 secured thereto as by soldering. The usual pin (not shown) is secured to the article on the side opposite the observer, to form a brooch.

Figure 32:
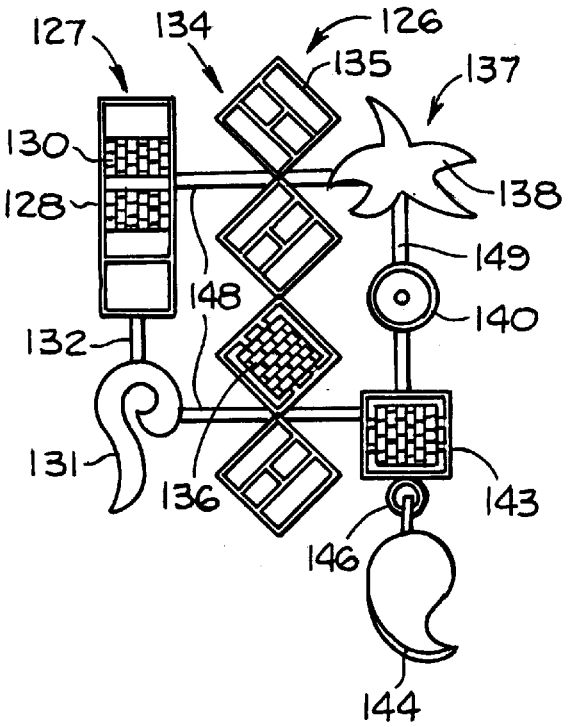
FIG. 32 is a face view of a brooch made up of a plurality of components in a square arrangement.

In the article 126 of FIG. 32, there are three tiers or vertical rows of items. A first one, 127 includes an article 128, similar to 118 and may or may not include beads 130. Below the item 128 is another item 131, eg of bright metal. A vertical rigid connecting rod 132 is soldered to the other two items as by soldering, forming a rigid tier.

A second tier 134 includes a plurality of frames, 135 eg four, similar to the item 114 of FIG. 31, soldered together corner-to-corner to form a rigid tier. The frames may or may not include beads 135.

A third tier 137 includes a top star 138 of bright metal, a second item 140, of the kind of 121 of FIG. 31. Next below the item 140 is a frame 143 similar to the frames 135, and at the bottom is a dangle 144 of suitable kind, hung at 146 so as to be free swinging. The three items 138, 140, 143 are secured together by vertical rigid connecting rods 147 as by soldering to form a rigid tier.

The three tiers are secured together by horizontal rigid connecting rods 148 to form a completely rigid article, except for the dangle 144, that is generally square or rectangular, and presents a square appearance, this being in contrast to the linear arrangement of FIG. 31. The item of FIG. 32 also contrasts with other items shown and described above in one case, FIGS. 4, 24, 25, where the components are flexibly secured together, and in another case, FIGS. 26, 27, 28, where each component, forming a brooch, is a separate and complete article.

A broad concept of the invention is the provision of a fixed and rigid frame and bead strung on a thread and held in the frame by the thread only, and without the use of adhesive material.

The various components and corresponding articles of the device are adapted to form any of a wide variety of pieces of jewelry, i.e. pendants, bracelets, necklaces, brooches, pins, etc.

The frame in any of the forms, may itself be considered an attractive element of the entire article. It may be made of silver, to present a bright appearance, or of different colors, such as produced by oxidation, which may be provided by treating the bare metal from which the frame is made. Any of various metals may be used, silver being a prominent one.

The beads are preferably of glass or ceramic material, and may be of a composition falling between pure glass and pure ceramic. The glass and the other materials (ceramic) present a sparkling effect and other attractive visual effects, adding to the attractiveness of the entire article of jewelry.

The beads may be predetermined as to color, uniform or mixed, location within a frame, relative to a space or relative to other beads, of different sizes, or in a pattern. This mixing of the beads results in attracting attention not only to the individual bead tubes, but to the entire article of jewelry as well.

What is claimed is:

1. An article of jewelry comprising, a one-piece frame, and beads mounted in the frame the frame including main structural elements, and bead bar means including bead bars mounted on at least one of the main structural elements, each individual bead having a threading hole therethrough, the beads being so mounted on the bead bars, the beads including at least one group, the beads of each group being strung on a thread passed through the holes in the beads, and capable of forming a rectangular web having end edges and side edges, the web being in the form of a tube surrounding one of the bead bars, and the ends of the web being stitched together.

2. An article of jewelry according to claim 1 wherein, the beads are held entirely by the thread and the structural elements, to the exclusion of adhesive material.

3. An article of jewelry according to claim 1 wherein, the main structural elements include peripheral members enclosing a main space, and cross members within the main space extending to and between the peripheral members, and the bead bars extend to and between respective ones of the main structural elements.

4. An article of jewelry according to claim 1 wherein, the bead bars are secured at only one end to a frame member, thereby forming prongs.

5. An article of jewelry according to claim 3 wherein, the bead bars extend to and between opposed ones of the peripheral members and cross members.

6. An article of jewelry according to claim 1 wherein the main structural elements include only peripheral members, and the bead bars extend to and between the peripheral members.

7. An article of jewelry according to claim 1 wherein, the bead bars are parallel and spaced apart, a tube of beads is mounted on and surrounding each bead bar, and the spacing of the bead bars is such that the next adjacent tubes are spaced apart.

8. An article of jewelry according to claim 1 wherein, the bead bar means includes are included in bar means having bead bars parallel and spaced apart, and the web is dimensioned to surround the entire bar means with elements of the web spaced apart in central areas of the bar means, and the web is in the form of a single tube surrounding all of the bead bars.

9. An article of jewelry according to claim 1 wherein, in combination with, other identical articles of jewelry wherein, all of the articles are pivotally connected together in series, whereby to form an articulated larger article exemplified by a bracelet, necklace, or an earring.

10. An article of jewelry according to claim 1 wherein, the article includes at least two articles, namely, an upper relatively small article and a lower relatively large article, and the upper article includes an outwardly extending pin, to form an earring of the combination articles.

11. An article of jewelry according to claim 1, wherein, the frame includes perimeter frame members surrounding a central space, and cross members in said central space and forming smaller spaces, bead bars are positioned in each of the smaller spaces, and the bead bars and thus the tubes of beads are positioned in the smaller spaces, and arranged relatively angularly in direction, progressing angularly around the frame.

12. An article of jewelry according to claim 1 wherein, the frame includes outer and inner peripheral members, forming a central space surrounded by the inner members, and a peripheral space between the outer and inner members, and the bead bars and tubes are positioned only in the peripheral space.

13. An article of jewelry according to claim 1, wherein, the frame includes a surrounding member and an interior member forming relatively wide and narrow spaces within the frame, the bead bars are positioned in the wide and narrow spaces respectively on common axes respectively extending through both the wide and narrow spaces, and the bead bars and tubes are provided in longer and shorter lengths in the wide and narrow spaces respectively in the pattern of an abacus.

14. An article of jewelry according to claim 1 wherein, the frame is in a shape similar to but modified relative to a football, having pointed ends and elongated curved side surfaces, the frame is flat relative to being positioned between spaced plane surfaces, the frame includes outer and inner members, forming peripheral spaces therebetween, the outer frame members merging in common points at the outer ends of the frame, the inner frame members each merging at one end with the corresponding outer frame member at a point displaced from the corresponding end point, and at the opposite end with the other inner member at a point displaced from the corresponding outer frame member, and the bars and beads thereon being disposed in said peripheral spaces with the axes of the bars extending essentially through the central area of the frame.

15. An article of jewelry according to claim 1 wherein, the beads are exposed to the exterior on both of opposite flat sides of the frame.

16. A combination of articles of jewelry according to claim 1 wherein, the frames are secured together rigidly to form a rigid device, and the device is provided with a clasp pin to form a brooch.

17. An article of jewelry comprising, a frame having a plurality of perimeter elements having outer surfaces lying in opposed planes, bead bars connected between the peripheral members and extending across the space therebetween, a group of beads mounted on at least certain of the bars, the beads of each group being sewn together by thread passing through the beads and arranged in a pattern having side edges and end edges, each web being so mounted on a corresponding bar by being wrapped around the bar with the end edges meeting, and the web thereby forming a tube on the bar, with the outer surfaces of the beads lying respectively adjacent the outer surfaces of the frame.

18. A bead tube comprising, a plurality of beads strung on a thread in an arrangement of rows extending in transverse direction and tiers extending longitudinally, thereby forming a web capable of forming a flat rectangular shape, with side edges and end edges, the web forming the tube, and the end edges essentially meeting, and the end edges of the meeting rows, being threaded together by the same thread on which the beads are strung, whereby the beads and thread form a self-contained article.

19. A combination of articles of jewelry according to claim 1 wherein, each article forms a complete component, each article is rigid, the articles are disposed in a linear arrangement, and the combination includes first rigid links rigidly secured to each two adjacent components in spaced apart relation.

20. A combination according to claim 19 and including, a plurality of such linear arrangements, and the combination includes additional rigid links rigidly connected to respective components in perpendicular relation to the first rigid links to form a square shape of the plurality of linear arrangements.

21. A method of making an article of jewelry that includes a frame and beads, wherein the frame includes bars for supporting beads, comprising the steps, providing a plurality of beads each having a threading hole therethrough, running a thread through the holes of a first row of beads, and successively oppositely through successive rows of beads, forming a web of the beads, the first and last rows of the web forming end edges, and the ends of the rows forming side edges, wrapping the web around a bead bar with the end edges of the web substantially meeting, leaving a trailing end of the thread out of the first end of the first row of beads, forming a tube, running the leading end of the thread in rearward direction through beads in rows anterior to the last row, and running the tailing end of the thread through beads in rows posterior to the first row, whereby the said trailing and leading ends of the thread function to hold the beads in the tube on the bead bars.

22. The method according to claim 21 and including the steps, tying a knot in the thread in said trailing end thereof, and during the course of running the thread through successive rows of beads, pulling the thread in leading direction so that the knot engages the first bead and the pulling action thereby pulls the beads together on the thread.

* * * * *